United States Patent [19]

Langejan

[11] Patent Number: 4,644,888

[45] Date of Patent: Feb. 24, 1987

[54] FLOATING HOPPER BARGE WITH DISCHARGING TRAP DOORS IN THE BOTTOM

[75] Inventor: Hendrik Langejan, Krimpen a/d Lek, Netherlands

[73] Assignee: IHC Holland N.V., Papendrecht, Netherlands

[21] Appl. No.: 878,403

[22] Filed: Jun. 20, 1986

Related U.S. Application Data

[63] Continuation of Ser. No. 712,002, Mar. 14, 1985, abandoned.

[30] Foreign Application Priority Data

Mar. 16, 1984 [NL] Netherlands ..... 8400861

[51] Int. Cl.[4] ..... B63B 35/30

[52] U.S. Cl. ..... 114/27; 114/29; 114/36

[58] Field of Search ..... 114/26–38

[56] References Cited

U.S. PATENT DOCUMENTS

| | | | |
|---|---|---|---|
| 138,179 | 4/1873 | Morris | 114/35 |
| 606,289 | 6/1898 | Lays | 114/37 |
| 926,597 | 6/1909 | Perry | 114/36 |
| 1,063,284 | 6/1913 | Reid | 114/36 |
| 1,397,527 | 11/1921 | Kulman | 114/37 |
| 3,698,573 | 10/1972 | Wolters et al. | 114/26 |

FOREIGN PATENT DOCUMENTS

| | | |
|---|---|---|
| 6816677 | 5/1970 | Netherlands . |
| 8006153 | 6/1982 | Netherlands . |
| 14591 | 3/1916 | United Kingdom . |

*Primary Examiner*—Sherman D. Basinger
*Assistant Examiner*—Stephen P. Avila
*Attorney, Agent, or Firm*—Young & Thompson

[57] ABSTRACT

A hopper vessel for storing bulk material such as dredged material, has one or more holds. The holds in their bottom are provided with trap doors that open by moving downwardly below the bottom of the vessel. In shallow water, there is the risk that these trap doors, when moved downwardly, will contact the bottom or the material that is deposited from the hopper vessel on the bottom. Therefore, some of the trap doors in the hold are at a higher level in the closed position than the other trap doors. To discharge material, the higher trap doors are opened first; and after enough material has been discharged that the vessel rises sufficiently high in the water, only then are the lower trap doors moved to open position to complete the discharge of the material. The higher trap doors are provided at the ends of the hold. This allows adjusting the angle of the vessel if the bottom of the body of water is sloped.

5 Claims, 4 Drawing Figures

FLOATING HOPPER BARGE WITH DISCHARGING TRAP DOORS IN THE BOTTOM

This application is a continuation of application Ser. No. 712,002, filed Mar. 14, 1985, now abandoned.

The invention relates to a floating hopper barge for depositing bulk material, such as dredged material, the said hopper barge having one or more holds which are provided with discharge means at the bottom in the form of trap doors which are below water level when the hopper is in the laden state.

A hopper of this type is generally known, for example from laid-open Dutch Patent Application No. 6,404,349, which patent application refers to a hopper barge with trap doors level with the bottom surface of the vessel which can swivel about horizontal longitudinal axes, these trap doors being swung down in the open position and projecting below the surface of the bottom of the vessel.

From British Patent No. 3666/1911 a hopper barge is also known which has conical trap doors in the bottom which can be moved up and down in the vertical direction, which in the closed position are above the surface of the bottom of the vessel and which in the open position project below the bottom.

These known hopper barges have the drawback that they cannot be used in shallow water or can only be used with considerable limitations because when the trap doors are opened they can foul the bottom. Opening usually takes place with the hopper barge fully laden, i.e. at maximum draught of the vessel.

The object of the invention is to provide a hopper barge which can also be used in shallow water, but which retains the advantages which are inherent in discharging by means of trap doors. The specific feature of trap doors is that they make rapid discharge possible and require relatively little maintenance. They are reliable and the operating mechanism is cheap and robust.

According to the invention this object is achieved in that one or more of the trap doors in a hold are at a higher level in the closed position than the other trap doors. According to the invention, in addition to the known trap doors which are as low as possible, trap doors are thus also provided which are considerably higher and are indeed so placed that in the open position they do not project below the bottom surface of the vessel or only project below it slightly. Such trap doors are per se also known, but the combination of trap doors in a low position with some at a high position makes it possible, while retaining a large load-carrying capacity, to discharge part of the cargo through the high-level trap doors, especially in cases where little room remains between the bottom of the vessel and the bottom of the water. As a result of a part of the cargo being discharged, the vessel rises in the water and room is created for discharging the remainder of the cargo through the low-level trap doors in the bottom, which can then no longer foul the bottom of the water.

The trap doors may be the per se known single or double trap doors in the bottom which swivel about horizontal axes which from a horizontal closed position swing into a vertical or almost vertical open position, or trap doors which are opened or closed by being moved in the vertical direction.

The higher-level trap doors are by preference situated at the extreme ends of a hold, which makes it possible to influence the position of the vessel with respect to the horizontal, which may be of importance if the bottom of the water is sloping near the bottom of the vessel.

It is noted that in the older Dutch Patent Application No. 8,303,723 not previously published a proposal has already been made to achieve the same object by replacing some of the trap doors in the bottom with cover slides. Cover slides have, however, the drawback that they are more difficult to seal and require more maintenance.

The invention will now be explained in more detail with reference to the drawings.

Figure 1:
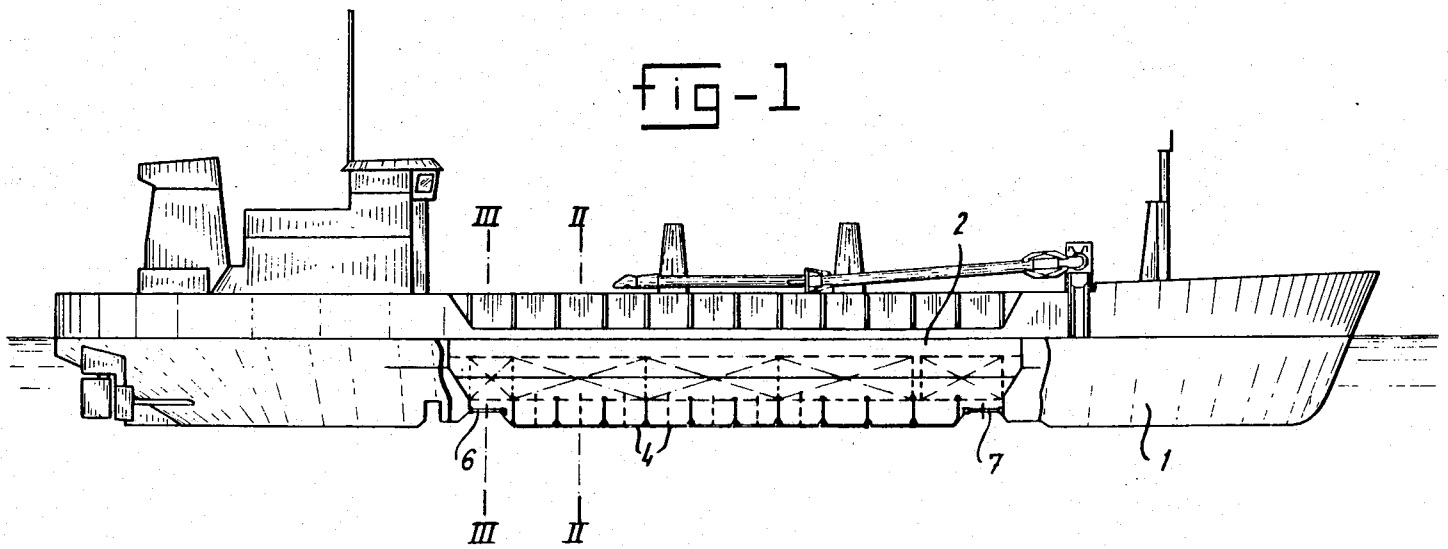
FIG. 1 shows diagrammatically a hopper barge according to the invention in longitudinal section.
Figure 2:
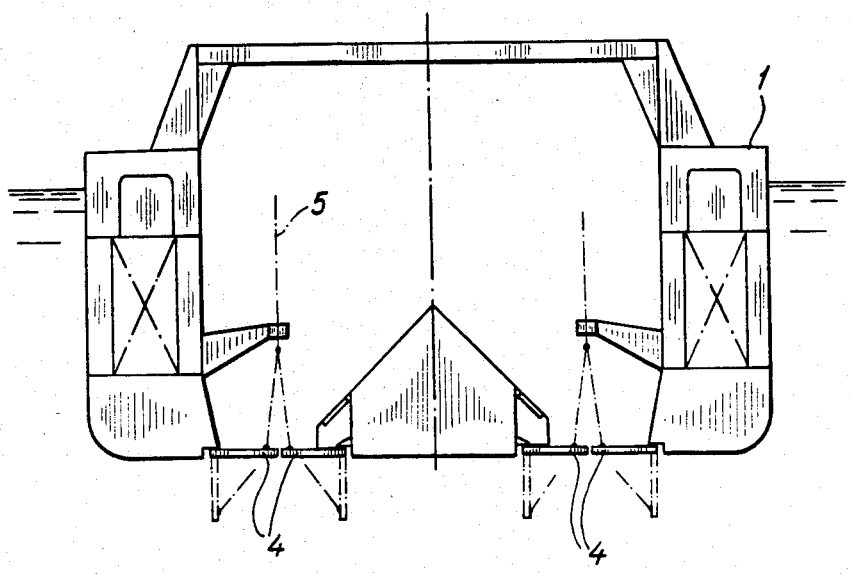
FIG. 2 is a cross-section along the line II—II in FIG. 1.

The hopper barge 1 shown in FIG. 1 has a hold 2 which is provided with two rows of discharging trap doors 4 in the bottom which are parallel to each other, and which can be swivelled about horizontal longitudinal axes and are held in the closed position shown in full line in FIG. 2 by means of pulling devices 5. In the open position, door 4 occupy the position shown by broken lines in FIG. 2.

The hold of the hopper barge is provided at the fore and aft ends with higher-level trap doors 6 or 7.

If the trap doors 6 or 7 are opened the cargo at these points can discharge downwards. The vessel then rises in the water, after which the trap doors 4 can be opened and the entire cargo can be discharged.

Figure 3:
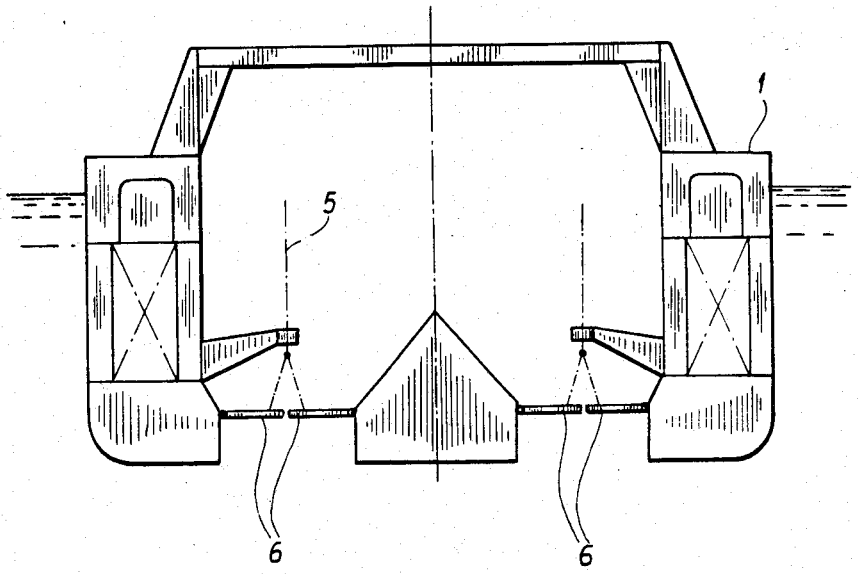
FIG. 3 is a cross-section along the line III—III in FIG. 1.

It will be clear that the higher-level trap doors 6 or 7 shown in FIG. 3 need not project below the bottom of the vessel in the open position.

Figure 4:
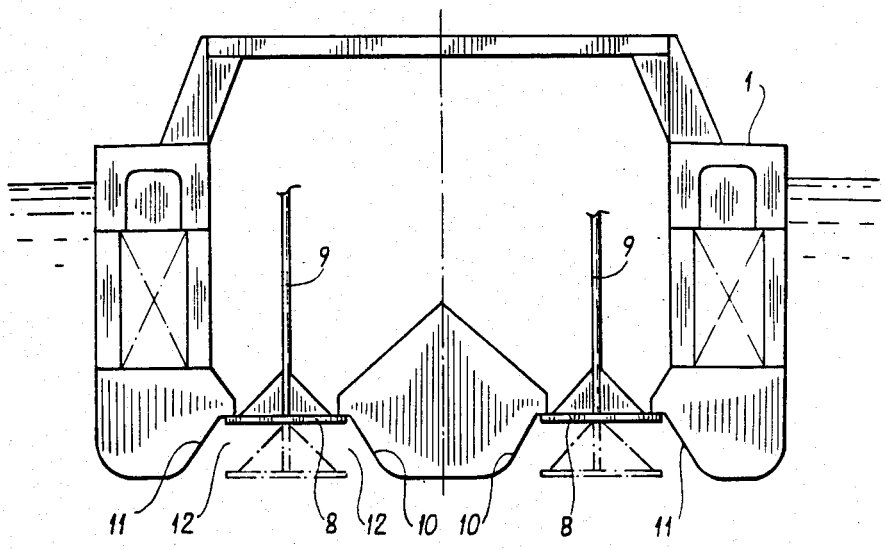
FIG. 4 is a cross-section similar to that in FIG. 3 but for a different type of trap door.

FIG. 4 shows another embodiment of the trap doors in the form of conical trap doors 8 which can be moved vertically up and down by means of the rods 9. This type of trap door is known per se and can also be used for the lower-level trap doors 4, which then project below the bottom in the open position.

If the conical trap doors 8 are provided at a higher level than shown in FIG. 4, then the side faces 10 of the dumping cage and the side faces 11 on the lateral sections of the hull should be designed so as to diverge downwards so that in the open position shown by broken lines, when the trap door is level with the bottom surface, flow channels 12 are formed.

It is also to be noted that it is of course possible to provide the whole vessel with trap doors installed at a higner level as, for example, is known from U.S. Pat. No. 1,063,284, FIG. 2. However, this is then achieved at the expense of the load-carrying volume.

I claim:

1. A hopper vessel for storing bulk material, comprising a bow and a stern, at least one hold disposed between the bow and the stern, a first plurality of trap doors that are disposed only in the bottom of the hold and that are spaced rearwardly of the bow and forwardly of the stern and that open by moving downwardly below the bottom of the vesel, and a second plurality of trap doors that are disposed only in the bottom of the hold and that are spaced rearwardly of the bow and forwardly of the stern and that open by moving downwardly to a level higher than the level to which said first plurality of trap doors moves down, both said first and said second plurality of trap doors being so disposed as to support material in the hold and to permit the discharge of material downwardly past said trap doors when said trap doors are moved downwardly to their open position, said at least one hold having an upwardly open top, and both said first and said second plurality of trap doors being disposed directly below said open top.

2. A hopper vessel as claimed in claim 1, in which said first plurality of trap doors comprises doors that are horizontal in their raised position and that open by swinging downwardly about horizontal axes to a lower position.

3. A hopper vessel as claimed in claim 2, in which said second plurality of trap doors comprises doors that are horizontal in their raised position and that open by swinging downwardly about horizontal axes to a lower position.

4. A hopper vessel as claimed in claim 1, in which said second plurality of trap doors comprises a plurality of conical members mounted for bodily vertical movement relative to the hold.

5. A hopper vessel as claimed in claim 1, in which said at least one hold is horizontally elongated and said second trap doors are located only at opposite ends of said at least one hold.

* * * * *